United States Patent [19]

Yan

[11] Patent Number: 4,915,818

[45] **Date of Patent: * Apr. 10, 1990**

[54] USE OF DILUTE AQUEOUS SOLUTIONS OF ALKALI POLYSULFIDES TO REMOVE TRACE AMOUNTS OF MERCURY FROM LIQUID HYDROCARBONS

[75] Inventor: Tsoung Y. Yan, Philadelphia, Pa.

[73] Assignee: Mobil Oil Corporation, New York, N.Y.

[ * ] Notice: The portion of the term of this patent subsequent to Nov. 14, 2005 has been disclaimed.

[21] Appl. No.: 160,440

[22] Filed: Feb. 25, 1988

[51] Int. Cl.[4] ..... C10G 17/00

[52] U.S. Cl. ..... 208/251 R; 208/284; 208/253; 210/702; 505/856

[58] Field of Search ..... 208/251 R, 284, 286, 208/296, 253; 505/856; 55/59, 74; 423/230; 210/702, 712, 717, 719, 723

[56] References Cited

U.S. PATENT DOCUMENTS

| | | | |
|---|---|---|---|
| 4,053,401 | 10/1977 | Fukushima et al. | 210/52 |
| 4,147,626 | 4/1979 | Findlay et al. | 210/52 |
| 4,354,942 | 10/1982 | Kaczur et al. | 210/712 |
| 4,614,592 | 9/1986 | Googin et al. | 210/679 |
| 4,619,744 | 10/1986 | Horton | 204/105 R |

*Primary Examiner*—Glenn Caldarola

*Attorney, Agent, or Firm*—A. J. McKillop; C. J. Speciale; R. B. Furr, Jr.

[57] ABSTRACT

Disclosed is a method of removing mercury from contaminated liquid hydrocarbons (natural gas condensate) by contacting them with a dilute aqueous solution of alkali metal sulfide salt and recovering the treated liquid hydrocarbon. The addition of alkali metal hydroxide enhances the phase separation of hydrocarbon and aqueous solution.

19 Claims, 6 Drawing Sheets

USE OF DILUTE AQUEOUS SOLUTIONS OF ALKALI POLYSULFIDES TO REMOVE TRACE AMOUNTS OF MERCURY FROM LIQUID HYDROCARBONS

NATURE OF INVENTION

This invention relates to the removal of trace amounts of mercury and its compounds from liquid hydrocarbons, such as liquid hydrocarbon condensate, crude oil and other petroleum products.

BACKGROUND OF THE INVENTION

Typical crude oils can contain about 0.5 to 10 ppb of mercury. Some hydrocarbon condensates from natural gas production contain higher levels of mercury. For example, the mercury content in the condensate from gas fields in Indonesia and Algeria have been found to be as high as 100 to 300 ppb. These high levels of mercury in crude oil can cause problems in processing steps. The accidental release and spill of accumulated mercury can lead to safety hazards. The release of mercury by the combustion of mercury-contaminated hydrocarbons poses environmental concerns.

The contact of mercury-contaminated condensate and other liquid hydrocarbons with certain aluminum processing equipment presents additional problems of equipment deterioration and damage. This results from the cumulative damaging effect of the mercury as it amalgamates with and corrodes the equipment. This is particularly true in low-temperature processing of hydrocarbon gases and liquids.

A primary object of this invention, accordingly, is to reduce the concentrations of mercury and its compounds present in hydrocarbon liquids, gas condensate, crude oil, and the like to levels where they are undetectable or at least non-threatening. Another object of this invention is to minimize or eliminate the emission of mercury into the atmosphere. Still another object of this invention is to achieve these reductions of mercury levels utilizing commercially available equipment which can be easily incorporated into current production systems.

BRIEF DESCRIPTION OF THE DRAWINGS

In the accompanying drawings

SUMMARY OF THE INVENTION

Briefly stated this invention comprises removing mercury and mercury compounds from liquid hydrocarbons such as natural gas condensate, crude oil, and other hydrocarbon liquids by contacting the hydrocarbon with a dilute aqueous alkali solution containing soluble sulfur and sulfide compounds. Preferably the solutions are made up of such compounds as sodium or potassium bisulfide, sulfide, or polysulfide and contains such ions as $HS^-$, $S_2^=$ and $S_X^=$ and their mixtures to levels of 1 to 50,000 ppm, but preferably 10 to 5,000 ppm. The pH of the solutions is controlled to a range of 7 to 12 with an alkali such as NaOH, KOH, or $Na_2CO_3$. A pH range of 8 to 11 is preferred. Volume ratios of aqueous solution to hydrocarbon liquid preferably range from 0.1 to 10. Mixing and settling temperatures of 50° F. to 300° F. can be used, although temperatures of 70° F. to 200° F. are preferred. The residence time for the mixture to react is 0.001 to 100 seconds depending upon the temperature and the type of sulfur compound used. The chemical reactions involved are as follows:

| | |
|---|---|
| $Hg + \frac{1}{2}S_2 \rightarrow HgS$ | and |
| $Hg^{++} + S^= \rightarrow HgS$ | and |
| $Hg + [S] \rightarrow HgS$ | |

[S] denotes active sufur derived from polysulfides, $S_X^=$.

Figure 1:
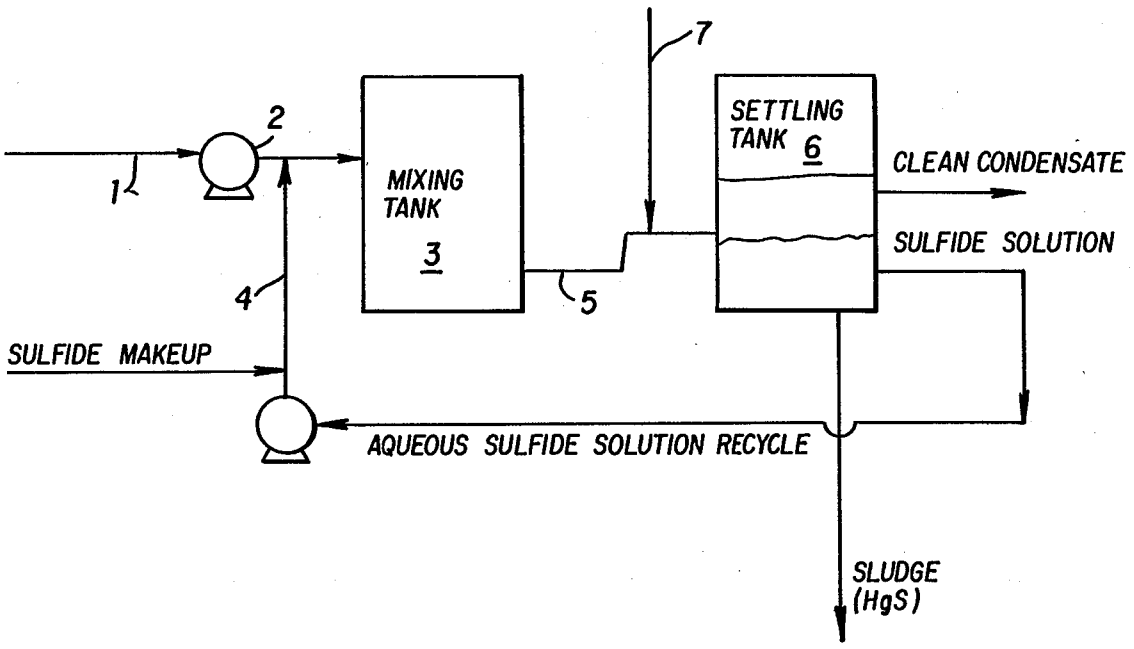
FIG. 1 is a flow sheet depicting one embodiment of the invention.

In the accompanying drawings FIG. 1 depicts a flow chart for the process. In FIG. 1 mercury-contaminated liquid hydrocarbon (condensate) is introduced through line 1 through pump 2 into mixing tank 3. An aqueous solution of the dilute alkali sulfide compound is introduced through line 4 into mixing tank 3 where the aqueous solution and liquid hydrocarbon are thoroughly agitated and mixed to permit reaction of the sulfur component with the mercury present in the hydrocarbon liquid.

The mixture is then flowed to a settling tank 6 through line 5 where the aqueous phase and hydrocarbon phase are allowed to settle out and separate. The two phases are then removed separately from the tank, the aqueous alkali sulfide solution being recycled, if desirable. Mercury-sulfur compounds settle to the bottom of the tank and are removed separately. The clean liquid hydrocarbon (condensate) is then ready for further processing. Because of the presence of the aqueous phase, the contamination of hydrocarbon by the sulfur compounds is limited and is estimated to be much less than 5 ppm due to the high partition coefficient of the sulfur compounds in water.

Line 7 shows a modification of the invention which is believed to be the best mode of practicing the process of this invention. It is discussed further in the description of the Examples.

EXAMPLES

The following examples show how 80 to 90 percent of the mercury present in a heavy condensate can be removed by treating it or washing it with water containing 100 to 1000 ppm of $Na_2S_X$. These examples illustrate among other features that:

- Mercury removal is improved by increasing the intensity of mixing and the ratio of volume of sodium polysulfide solution to naphtha; increases in concentration of sodium polysulfide solutions have a diminishing effect on increasing mercury removal;
- The aqueous solution of sodium polysulfide treating solution can be used repeatedly by replenishing it with a stock solution. A small amount of the polysulfide is consumed by reacting with mercury and losing it as a contaminant to the naphtha phase;
- The moisture content of the treated product is lower than that of the feedstock.

For the following test examples the condensate used had an API gravity of 53.0° and an analysis for saturates of 52.1%. The condensate sampled had weathered and been depleted of the $C_1$–$C_6$ fraction. They contained 20% of $C_{16}$+material. The mercury content of the condensate was 220 ppb. A $Na_2S_x$ stock solution containing 25.5% of sulfur was prepared. Treating sulutions of various $Na_2S_x$ concentrations were prepared from this stock by diluting it with water.

Twenty-five (25−) cc portions of condensate were mixed with measured volumes of $Na_2S_x$ and NaOH aqueous solutions of varied concentrations. The mixtures were mechanically homogenized with a blender, and after each had been allowed to settle for 1 to 5 minutes, the resulting oil and aqueous phases were separated. The oil phase from each run was analyzed for water, sulfur and mercury content. The test results suggest that the most important process variables in removing mercury from the condensate are intensity of mixing, concentration of $Na_2S_X$, volume ratio of $Ma_2S_X$ solution of caustic, and efficiency of phase separation.

EXAMPLE 1

Dilute $Na_2S_x$ aqueous solution is effective for removing mercury from heavy condensate. In two test conducted as described previously solutions containing 10,000 and 20,000 ppm of $Na_2S_x$ were mixed in a ratio of two volumes of condensate to one volume of aqueous $Na_2S_X$ solution. Mercury levels in the condensate were determined to have been reduced from 220 ppb to 31 and 43 ppb respectively after the condensate was separated and analyzed for mercury content.

EXAMPLE 2

Aqueous $Na_2S_X$ solutions containing 2,000, 1,000, 500 and 100 ppm of sulfur, each also containing 0.8% by weight of MaOH were mixed with condensate in a ratio of two volumes of condensate to one of treating solution. The mercury concentrations in the condensate samples decreased correspondingly from 220 ppb to 66, 133, 77 and 110 ppm respectively. The amount of mercury removed thus increases generally with increases in sodium sulfide concentrations. In these particular tests, however the decrease in mercury level in the condensate was about four-fold, while the increase in sodium sulfide concentration of the treating solution was 200-fold. These results suggest that increases in sodium sulfide concentration does not proportionally improve mercury removal.

EXAMPLE 3

When $Na_2S_X$ solutions containing 220,000 ppm, 20,000 ppm and 1,000 ppm of sulfur were mixed in a ratio of two volumes of condensate to one volume of sulfide solution, sulfur contamination of the condensate decreased from 700 to 100 to 50 ppm respectively. The concentration of $Na_2S_X$ in the aqueous solution thus has a profound effect on sulfur contamination of the treated condensate. The sulfur contamination can be minimized by reducing the $Na_2S_X$ concentration of the aqueous solution.

EXAMPLE 4

An aqueouss solution containing 0.8% sodium hydroxide and 1,000 ppm of sulfide was mixed in a ration of two volumes of condensate to one volume of sulfide solution. The condensate contained originally 220 ppb of mercury which was reduced to 133 ppb. The same aqueous solution was used to treat second and third batches were batches were reduced to 167 and 75 ppb. There is no apparent loss of efficacy of the solution resulting from its repeated use. The variation in mercury removal in these tests was deemed to be a result of inconsistency in mixing intensities. Thus, the treating solution can be recycled for repeated use.

EXAMPLE 5

When sodium sulfide solutions containing 500 and 1,000 ppm of sulfur were mixed with comparable volumes of mercury-contaminated condensate under conditions where the intensity of mixing of the 500 ppm solution was greater than that of the 1,000 ppm polution the removal of mercury using the lower concentration solution was greater than that using the higher concentration. Mercury concentration was reduced from 220 ppb to 110 ppb in the case using the lower concentration, and only to 133 in case using the higher concentration. Mercury removal is limited by liquid/liquid contact, so that intense mixing is a key to successful mercury removal.

EXAMPLE 6

When mercury-contaminated condensate containing 220 ppb of mercury was mixed with sodium sulfide solution in increasing volumetric ratios of 0.2, 0.5, and 1 respectively (sulfide solution/condensate) the mercury concentrations were reduced correspondingly to 164, 133, and 75 ppb. Mercury removal increases with increased ratios of volume of treating solution to volume of condensate. Improved mercury removal at high volumetric ratios of treating solution to oil is due to improved mixing indirectly. As the ratio of treating solution to oil is increased, oil-in-water emulsions are created by intensive mixing and oil molecules are exposed to treating solution leading to high levels of mercury removal. When the volumetric ratio is low, water-in-oil emulsions are obtained and oil contact with the solution is limited.

EXAMPLE 7

The condensate feedstock when saturated with water contained 169 ppm. Upon treating with $Na_2S_x$ solution, the moisture content of the condensate becomes lower than the original concentration in the feedstock. Thus, the condensate was not conaminated with water in this treating method.

In another series of studies the intensity of mixing of mercury-contaminated condensate and aqueous polysulfide solution in small concentrations was demonstrated to be a critical process. In this study, the mixing of heavy condensate and aqueous sodium polysulfide solution was effected with a commercial Waring blender. To control the intensity of the blending, the blender was set at the lowest reading and connected to a power-stat which was varied from 20 to 100%. The mercury content in the original heavy condensate was approximately 200 ppb.

EXAMPLE 8

Figure 2:
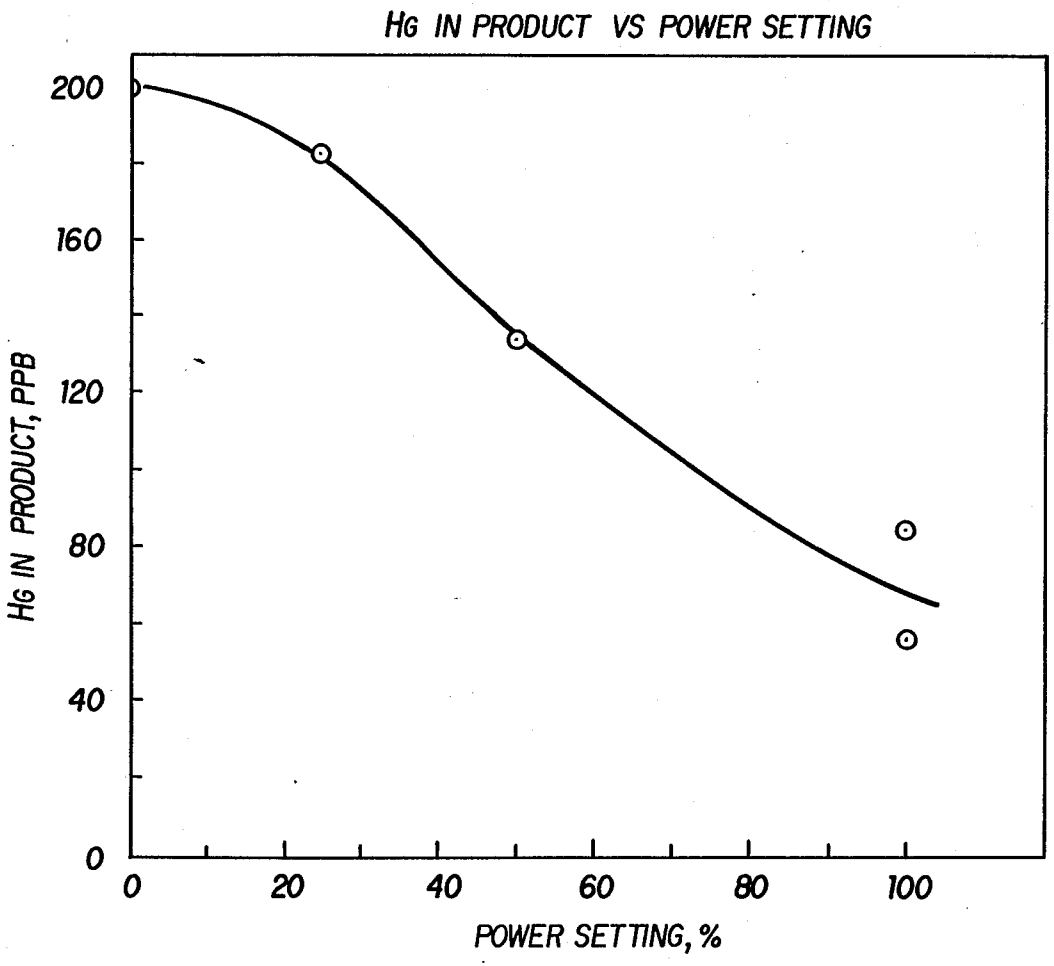
FIG. 2 is a plot of data showing the effect of power input to the mixing equipment on the removal of mercury from condensate.

When the power setting was raised to increase the mixing intensity, the mercury removal was increased (FIG. 2). At 20 and 30% settings, the mixing was poor. The mercury concentration in the product was about 180 ppb representing a mercury removal of about 10%. As the power setting was increased to 50 and 100%, the mercury removal efficiency increased and the mercury concentrations in the products decreased to 134 and 71 ppb, corresponding to 33 and 65% mercury removal, respectively. These results underscore the importance of mixing intensity for mercury removal.

EXAMPLE 9

Figure 3:
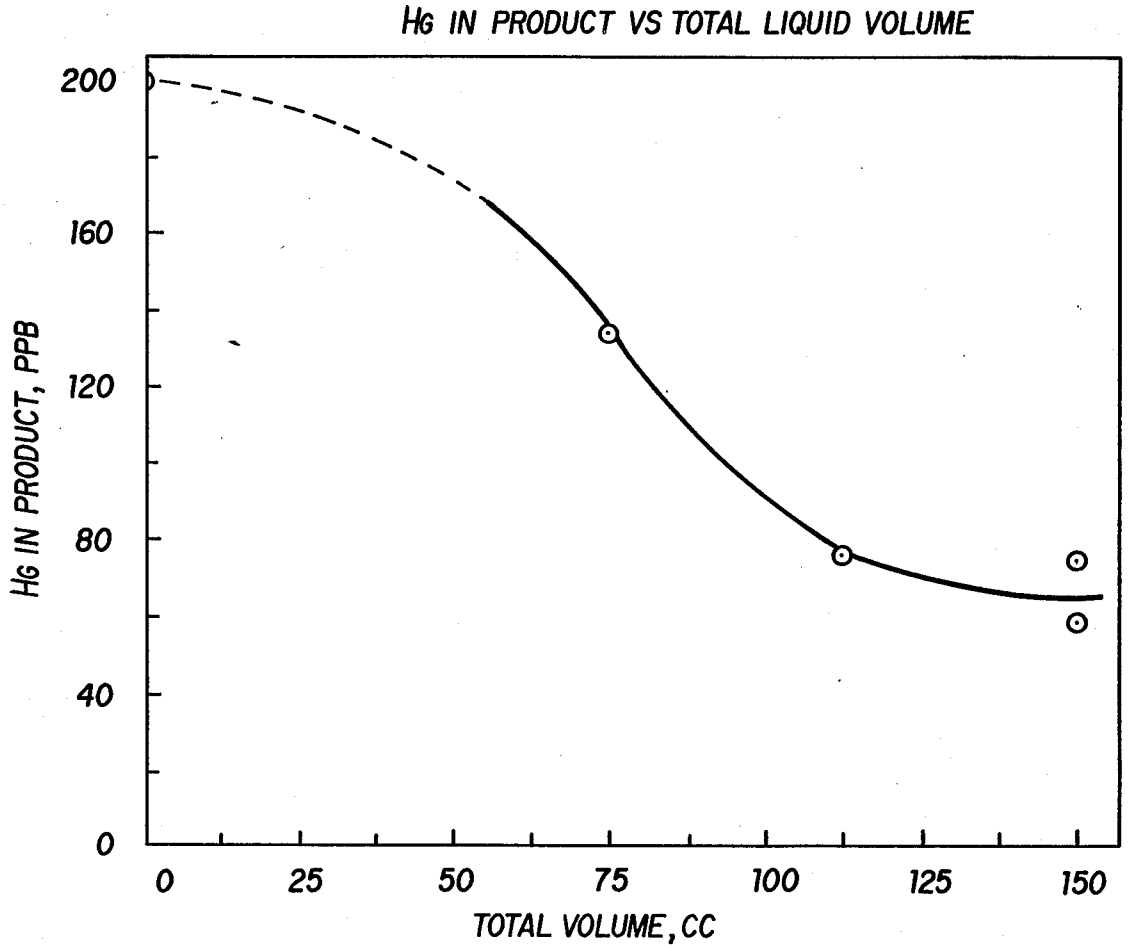
FIG. 3 is a plot showing the effect of total volumes of mixtures of polysulfide solution and condensate.

As the total liquid volume was increase to cover the blade of the blender completely, the mixing intensity was increased leading to higher mercury removal (FIG. 3).

When the total liquid volume was 75 cc, the liquid barely covered the blade and the vortex reached the bottom as the blender was started. As a result, mixing was poor and the mercury removal was 39%. On the other hand when the volume was increased to 112.5 cc, the blade was well covered and the mercury removal increased to 65%. Further increase in the total liquid volume to 150 cc, increased the mercury removal efficiency only slightly to 67%. The effect of total liquid volume on mercury removal efficiency is an artifact due to the blender configuration but it also points to the importance of mixing intensity.

EXAMPLE 10

Figure 4:
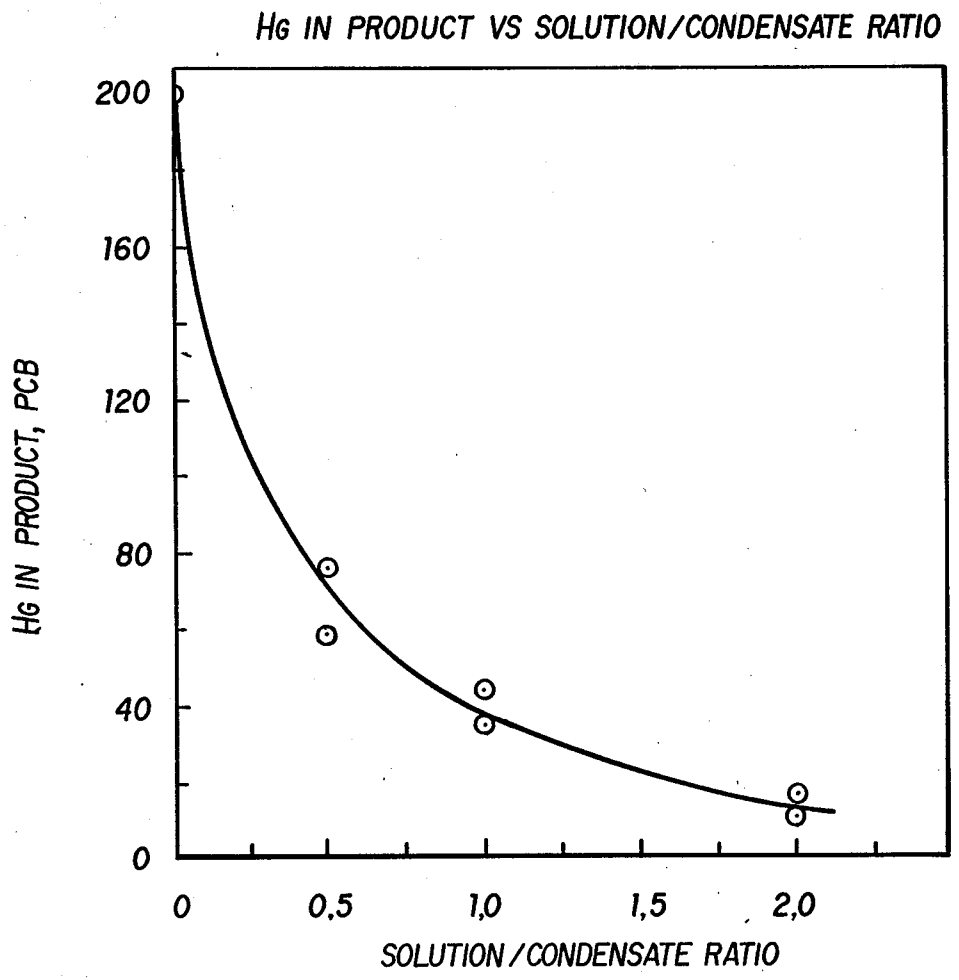
FIG. 4 is a plot showing the effect of the ratio of volume of aqueous polysulfide solution to volume of condensate.

The mercury removal efficiency increased greatly as the solution-to-condensate volume ratio was increased (FIG. 4).

For the same power setting, as the volume ratio of solution to condensate was increased from 0.5 to 1 and 2 the mercury removal efficiency was increased from 67 to 80 and 95%, respectively. This dramatic improvement in mercury removal is due to the improved liquid/liquid contact. As the solution to condensate ratio increased from low to high levels, the nature of the mixture changed from water-in-oil to oil-in-water emulsion. In the oil-in-water emulsion, the oil was highly dispersed in the water thus exposing all the mercury present for reaction leading to high mercury removal.

EXAMPLE 11

Figure 5:
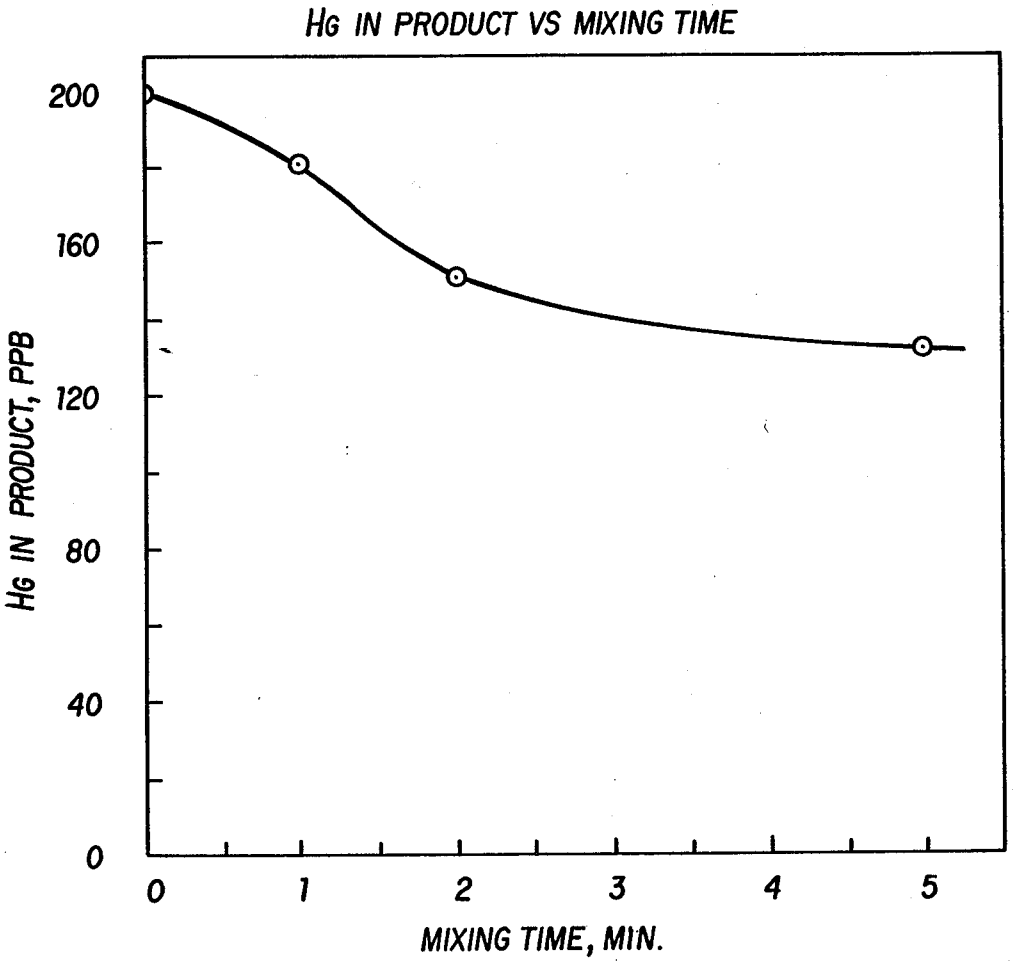
FIG. 5 is a graph showing the effect of mixing time on the removal of mercury from condensate.
Figure 6:
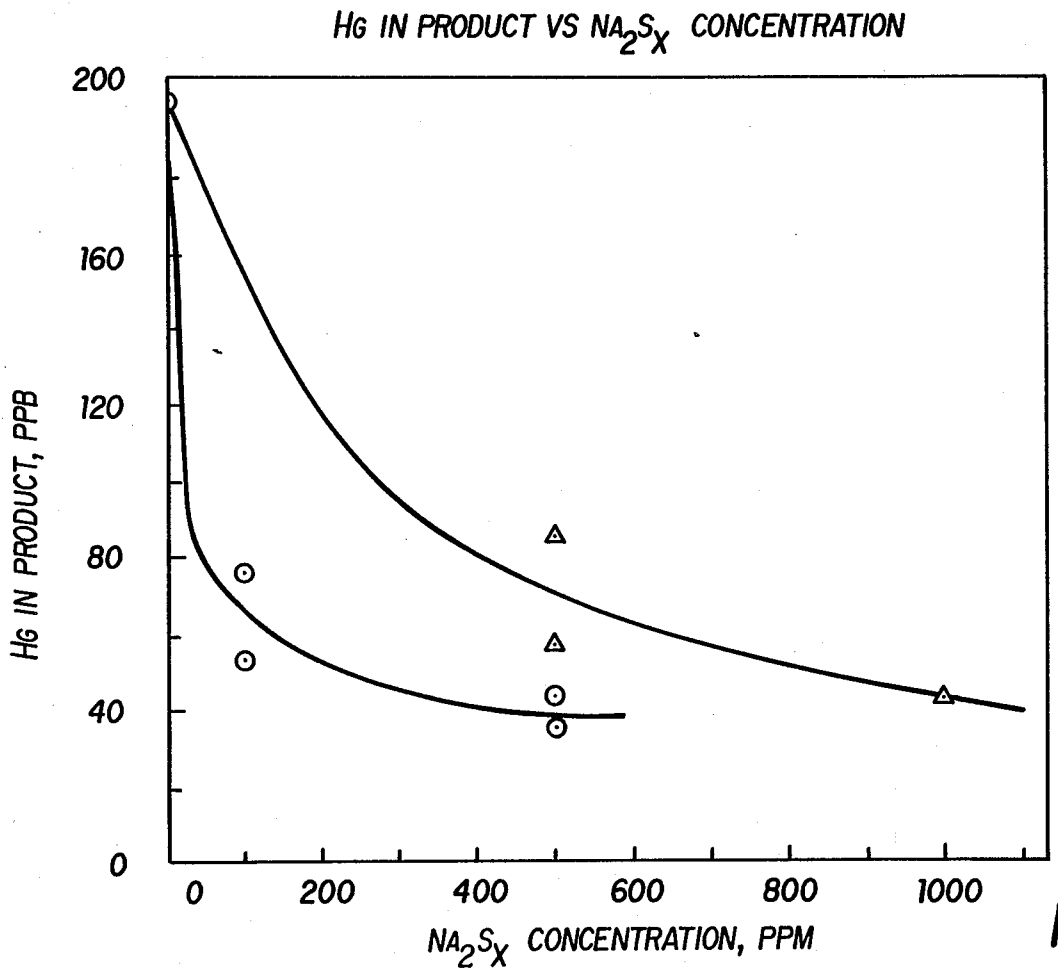
FIG. 6 is a plot showing the effect of sodium polysulfide concentration on mercury removal.

As the mixing time increased, the mercury concentration in the products decreased and the degree of mercury removal increased as expected (FIG. 5). However the impact was small in comparison with other more influential factors. The effect of mixing time was small in this comparison (Runs 2, 5 and 6), partially because the power setting was at only 30%.

EXAMPLE 12

As the $Na_2S_x$ concentration of the solution is increased, mercury removal efficiency is increased (FIG. 5). The impact of $Na_2S_x$ concentration is reduced when the mixing intensity is increased. Thus, it becomes possible to remove mercury to a great extent with a solution of low $Na_2S_x$ concentration by increasing the mixing intensity.

The mercury concentrations in the treated condensate product with $Na_2S_x$ concentrations at 500 ppm and 1000 ppm were 86 and 56 and 43 ppb, respectively. In contrast to this series of runs, higher levels of mercury removal were achieved with a low $Na_2S_x$ concentration of 100 ppm in Runs 14 and 19 (Table 1). This was achieved by increasing the solution-to-condensate ratio from 0.5 to 1 and 2 to turn the mixture into an oil-in-water emulsion. It is interesting to note that the effect of $Na_2S_x$ concentration on mercury removal became less pronounced as the solution-to-oil ratio and mixing intensity were increased.

EXAMPLE 13

Additional tests were conducted using mercury-contaminated pentane to simulate a mercury-contaminated condensate. The pentane contained 320 ppb of mercury. In each test an aqueous solution of sodium sulfide of predetermined concentration (50 to 200 ppm of sulfur) was mixed with the pentane and the mixture agitated. The mixtures were then allowed to separte into phases and the mercury concentration of the pentane phase was determined. Results were as follows:

TABLE 1

| Sample No. | I | II | III | IV |
|---|---|---|---|---|
| Aqueous solution | | | | |
| $S(Na_2S_s)$, ppm | 50 | 100 | 150 | 200 |
| Volume used, cc | 200 | 200 | 200 | 200 |
| $C_5$ feed | | | | |
| Volume treated, cc | 25 | 25 | 25 | 25 |
| Hg in feed, ppb | 320 | 320 | 320 | 320 |
| Hg in product, ppb | 1.22 | 2.41 | 0.20 | 0.45 |
| | | | 0.20 | 0.60 |
| Hg removal, % | 99.4 | 98.7 | 99.4 | 99.9 |
| | | | 99.4 | 99.8 |

From these results it is readily discernible that the treatment with dilute alkali sulfide results in a substantial removal of mercury.

EXAMPLE 14

Tests were also conducted to determine the degree of contamination resulting from contacting hydrocarbons with sulfur. It was determined that the condensate (n-pentane) will increase in sulfur content by about 1 to 5 ppm. The average sulfur content of condensate encountered in petroleum processing is around 250 ppm, so an increase of 1 to 5 ppm can be tolerated.

EXAMPLE 15

An unexpected benefit results from the addition of an alkali metal hydroxide, such as sodium hydroxide, to the aqueous solution of alkali metal sulfide. Its presence promotes the separation of the aqueous and oil phases after the initial contact period is over. Another embodiment of the present invention and what is believed to be the best mode of practicing it, thus, is to incorporate between 0.01 and 0.04 percent by weight of alkali metal hydroxide into the wash solution particularly after it has been reacted with the alkali metal sulfide. In addition to sodium hydroxide, other usable metal hydroxides include KOH.

To demonstrate the desirability of incorporating alkali metal hydroxides into the process, tests were run wherein various amounts of alkali metal hydroxide were incorporated in a solution of sodium sulfide, the two were mixed with field-produced condensate, and the length of time measured for the two phases to separate. Results are shown in Table 2 as follows:

TABLE 2

Phase Separation of Field Condensate/$Na_2S_x$ Solution
Volume of condensate: 15 cc
Volume of $Na_{2x}$ solution: 15 cc
Temperature: 75° F.

| Sample | Sulfur in $Ns_2S_x$ Solution Weight % | NaOH in Aqueous Solution: From $Na_2S_x$ Weight % | NaOH in Aqueous Solution: Added Weight % | Separation Time Sec | Aqueous Phase |
|---|---|---|---|---|---|
| 1 | 22 | 13.75 | 0 | 32 | clear |

TABLE 2-continued

Phase Separation of Field Condensate/$Na_2S_x$ Solution
Volume of condensate: 15 cc
Volume of $Na_{2x}$ solution: 15 cc
Temperature: 75° F.

| Sample | Sulfur in $Ns_2S_x$ Solution Weight % | NaOH in Aqueous Solution: From $Na_2S_x$ Weight % | NaOH in Aqueous Solution: Added Weight % | Separation Time Sec | Aqueous Phase |
|---|---|---|---|---|---|
| 2 | 2 | 1.25 | 0 | 34 | clear |
| 3 | 0.1 | 0.04 | 0 | 300 | hazy |
| 4 | 0.01 | 0.01 | 0 | 500 | hazy |
| 5 | 0.1 | 0.06 | 3.3 | 27 | clear |
| 6 | 0.01 | 0.01 | 3.3 | 38/36* | clear |
| 7 | 0.01 | 0.01 | 1.7 | 22/22* | clear |
| 8 | 0.01 | 0.01 | 0.83 | 20/18* | clear |
| 9 | 0.01 | 0.01 | 0.41 | 400 | hazy |

Based on the data above there is an optimum level of NaOH addition for phase separation (cf. Samples 4, 6, 7, 8 and 9,) The optimum level is about 0.83% NaOH. It is not understood why there should be an optiumum and why the optimum level is so low. This optimum level will vary somewhat with variation in the washing temperature and composition of the condensate and impurities in the aqueous phase.

I claim:

1. A method for removing mercury from a mercury-contaminated liquid hydrocarbon comprising contacting it with an aqueous dilute solution of alkali metal sulfide salts and separating a liquid hydrocarbon phase substantially free of mercury from said mixture of mercury-contaminated liquid hydrocarbon and aqueous dilute alkali metal sulfide solution.

2. A method for removing mercury from a mercury-contaminated liquid hydrocarbon comprising:

(a) intimately contacting said liquid hydrocarbon with an aqueous solution of an alkali metal sulfide salt for a period of time sufficient for said mercury and said sulfide to react to form insoluble mercury-sulfur compounds;

(b) separating said liquid hydrocarbon and said aqueous solution into separate phases; and (c) recovering said liquid hydrocarbon.

3. The method of claim 2 wherein said aqueous solution of alkali metal sulfide contains between about 1 and about 50,000 ppm of sulfur percent in said solution.

4. The method of claim 2 wherein said alkali metal sulfide is selected from the group consisting of NaHS, KHS, $Na_2S$, $K_2S$, sodium polysulfide, and potassium polysulfide.

5. The method of claim 2 wherein the volume ratio of alkali metal sulfide salt solution to hydrocarbon liquid is between about 0.1 and about 10.

6. The method of claim 2 wherein the temperature is between about 50° F. and about 300° F.

7. A method for removing mercury from a mercury-contaminated liquid hydrocarbon comprising:

(a) intimately contacting said liquid hydrocarbon with an aqueous solution of an alkali metal sulfide salt for a period of time sufficient for said mercury and said sulfide to react to form insoluble mercury-sulfur compounds;

(b) intimately mixing with said aqueous sulfide solution either before or after mixing with said liquid hydrocarbon an alkali metal salt or hydroxide;

(c) separating said liquid hydrocarbon and said aqueous solution into separate phases; and (d) recovering said liquid hydrocarbon.

8. The process of claim 7 wherein said aqueous solution of alkali metal sulfide contains between about 1 and about 50,000 ppm of sulfur in said solution.

9. The method of claim 7 wherein said alkali metal sulfide is selected from the group consisting of NaHS, KHS, $Na_2S$, $K_2S$, sodium polysulfide, and potassium polysulfide.

10. The method of claim 7 wherein the volume ratio of alkali metal sulfide salt solution to hydrocarbon liquid is between 0.1 and 1.

11. The method of claim 7 wherein the temperature is between about 50° F. and about 300° F.

12. The method of claim 7 wherein the pH of the aqueous alkali metal sulfide solution is between about 7 and about 12.

13. Th method of claim 7 wherein the concentration of alkali metal hydroxide in said aqueous sulfide solution is between about 0.01 and about 0.04 percent.

14. The method of claim 7 wherein the alkali metal hydroxide is selected from the group consisting of sodium hydroxide, potassium hydroxide, sodium or potassium carbonate, and sodium or potassium bicarbonate.

15. The method of claim 7 wherein the queous alkali metal salt or hydroxide solution is a buffered solution.

16. The method of claim 7 wherein the mixing of aqueous alkali metal salt or hydroxide solution, aqueous sulfide solution, and liquid hydrocarbon is effected by means of a centrifugal pump, static mixer, or series of orifices.

17. The method of claim 2 and adding sodium hydroxide to and maintaining between about 0.01 and about 10% concentration of alkali metal sulfide salt in said aqueous solution.

18. A method for removing mercury from a liquid hydrocarbon comprising enulsifying said liquid hydrocarbon with an aqueous solution of an alkali metal polysulfide and separating a liquid hydrocarbon phase substantially free of mercury from said emulsified mixture of liquid hydrocarbon and aqueous solution of alkali metal polysulfide.

19. The method of claim 18 wherein the aqueous solution of alkali metal polysulfide is sodium polysulfide and in the resulting emulsion the aqueous solution is the continuous phase and the liquid hydrocarbon is the dispersed phase.

* * * * *